US008086129B2

(12) United States Patent
Nishimoto

(10) Patent No.: US 8,086,129 B2
(45) Date of Patent: Dec. 27, 2011

(54) IMAGE FORMING APPARATUS AND CARTRIDGE THEREFOR

(75) Inventor: Kazunari Nishimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 387 days.

(21) Appl. No.: 12/357,783

(22) Filed: Jan. 22, 2009

(65) Prior Publication Data

US 2009/0196647 A1 Aug. 6, 2009

(30) Foreign Application Priority Data

Feb. 5, 2008 (JP) ..... 2008-024968
Jan. 7, 2009 (JP) ..... 2009-001983

(51) Int. Cl.
*G03G 15/00* (2006.01)

(52) U.S. Cl. ..... 399/90

(58) Field of Classification Search ..... 399/25, 399/83, 90
See application file for complete search history.

(56) References Cited

U.S. PATENT DOCUMENTS 5,937,239 A 8/1999 Watanabe et al. ..... 399/111
6,922,534 B2 7/2005 Goto et al. ..... 399/12
7,130,572 B2 10/2006 Kubochi et al. ..... 399/329
2003/0091361 A1 * 5/2003 Noda et al. ..... 399/90
2003/0123896 A1 * 7/2003 Goto et al. ..... 399/90

FOREIGN PATENT DOCUMENTS

JP 9-179476 7/1997
JP 2003-195726 7/2003

* cited by examiner

*Primary Examiner* — David Gray
*Assistant Examiner* — Frederick Wenderoth
(74) *Attorney, Agent, or Firm* — Fitzpartick, Cella, Harper & Scinto

(57) ABSTRACT

An image forming apparatus has a movable member including a first shaft, a second shaft, a main assembly electrical contact, and a second contact portion for being contacted by the first contact portion when a cartridge is mounted to the apparatus. There is also a first guide portion, for guiding the first shaft such that the movable member is rendered movable in the inserting direction by the second contact portion being pushed by the first contact portion when the cartridge is mounted to the main assembly of the apparatus, and a second guide portion for guiding the second shaft by the second contact portion being pushed by the first contact portion when the cartridge is mounted to the main assembly of the apparatus, such that the movable member is rotated about the first shaft in a direction of electrically connecting the main assembly electrical contact to the cartridge electrical contact.

17 Claims, 11 Drawing Sheets

IMAGE FORMING APPARATUS AND CARTRIDGE THEREFOR

FIELD OF THE INVENTION AND RELATED ART

The present invention relates to an image forming apparatus, and a cartridge removably mountable in an image forming apparatus.

Here, an "image forming apparatus" includes an electrophotographic copying machine, an electrophotographic printer (for example, LED printer, laser beam printer, etc.), an electrophotographic facsimile apparatus, an electrophotographic word processor, etc.

A "process cartridge" means a cartridge in which an electrophotographic photosensitive member, a charging means, and a developing means or cleaning means, are integrally disposed, and which is removably mountable in the main assembly of an image forming apparatus. It also means a cartridge in which an electrophotographic photosensitive member, and at least one among a charging means, a developing means, and a cleaning means are integrally disposed, and which is removably mountable in the main assembly of an image forming apparatus. Further, it is a cartridge in which an electrophotographic photosensitive member, and at lease a developing means, are integrally provided, and which is removably mountable in the main assembly of the main assembly of an image forming apparatus.

In the field of image forming apparatus of the type using an electrophotographic image formation process, long employed has been a process cartridge in which an electrophotographic photosensitive member, and one or more means for processing the electrophotographic photosensitive member, are integrally disposed. The process cartridge system makes it possible for a user to maintain an electrophotographic image forming apparatus without the help from a service person. Thus, it can drastically improve an electrophotographic image forming apparatus in terms of operational efficiency. Thus, it is widely used in the field of an image forming apparatus.

Japanese Laid-open Patent Application H09-179476 proposes a technology related to a process cartridge system, such as those described above. More specifically, according to one of the preferred embodiments of that Japanese Laid-open patent application, a process cartridge is provided with a storage means, such as an IC memory or the like, for storing the information which is to be transmitted to the main assembly of an image forming apparatus. Thus, as this process cartridge is mounted into the main assembly of an image forming apparatus, information can be exchanged between the process cartridge and the main assembly, so that the control portion of the main assembly can have communicated to it information on the condition of the process cartridge. Further, such information as the lot number of the cartridge, the characteristics of the image forming apparatus, the characteristics of the processing means, etc., is registered in the memory of the storage means of the process cartridge. Not only does the availability of this type of information make it easier to maintain the main assembly of an image forming apparatus, and/or a process cartridge, but also, make it possible for the control portion to control the image formation process according to the information stored in the storage means, ensuring that an image is formed under the optimal condition.

As for the means for establishing electrical connection between the storage means of a process cartridge and the main assembly of an image forming apparatus, it has been proposed in Japanese Patent 3809375 to employ a movable member as the means for establishing the electrical connection. More specifically, according to that Japanese patent, the electrical contacts of the main assembly of the image forming apparatus are held by the movable member. During the insertion of the process cartridge into the main assembly, the movable member comes into contact with a part of the process cartridge, and is moved by the cartridge in such a manner that the electrical contacts held by the movable member come into contact with the electrical contacts on the process cartridge. In other words, in the case of this patent, the movable member, with which the electrical contacts on the main assembly side are held, is correctly positioned relatively to the process cartridge by the direct contact between the movable member and process cartridge. Thus, the electrical contacts held by the movable member properly align with the electrical contacts on the process cartridge. Therefore, it is said to ensure that reliable electrical connection is made between the process cartridge and movable member.

In the above described case where the movable member in accordance with the prior art is employed, the image forming apparatus is designed in a manner that the electrical contacts of the process cartridge and those of the main assembly come into contact with each other while the process cartridge is still being moved into the main assembly of the image forming apparatus. That is, the electrical contacts of the process cartridge make contact with those of the main assembly before the process cartridge is moved into its final position in the main assembly. Thus, as the process cartridge is inserted further into the main assembly after the occurrence of contact between the electrical contacts on the process cartridge and the counterparts on the movable member, the point of contact between each of the electrical contacts on the process cartridge and the counterpart on the movable member shifts in the direction in which the cartridge is being inserted. In other words, the locus of the point of contact between each of the electrical contacts on the process cartridge and the counterpart on the movable member is rather long, making it necessary for the electrical contacts on the process cartridge to be substantially longer than necessary for the establishment of electrical connection between the electrical contacts on the process cartridge and the counterparts on the movable member.

SUMMARY OF THE INVENTION

Thus, the primary object of the present invention is to reduce in size the electrical contacts of a process cartridge by shortening the locus of the point of contact between each of electrical contacts of the process cartridge and the counterpart of the main assembly of an image forming apparatus.

According to an aspect of the present invention, there is provided an image forming apparatus including a main assembly of the apparatus to which is mountable a cartridge having a storing element for storing information, a cartridge electrical contact electrically connected with the storing element, and a first contact portion, said image forming apparatus comprising a movable member including a first shaft, a second shaft, a main assembly electrical contact for electrical connection with the cartridge electrical contact when said cartridge is set to the main assembly of said apparatus, and a second contact portion for being contacted, when said cartridge is mounted to said main assembly of the apparatus, by the first contact portion to receive a force in an inserting direction in which said cartridge is mounted to said main assembly of the apparatus; a first guide portion, rotatably supporting said first shaft, for guiding said first shaft such that the movable member is rendered movable in the inserting direction by said second contact portion being pushed by the first contact portion when said cartridge is mounted to said main assembly of the apparatus; and a second guide portion for guiding said second shaft by said second contact portion being pushed by the first contact portion when said cartridge is mounted to said main assembly of the apparatus, such that movable member is rotated about said first shaft in a direction of electrically connecting said main assembly electrical contact to said cartridge electrical contact.

According to another aspect of the present invention, there is provided an image forming apparatus including a main assembly of the apparatus to which is mountable a cartridge having a storing element for storing information, a cartridge electrical contact electrically connected with the storing element, and a first contact portion, comprising a movable member including a shaft, a main assembly electrical contact for electrical connection with said cartridge electrical contact when said cartridge is set to the main assembly of said apparatus, a second contact portion for being contacted, when said cartridge is mounted to said main assembly of the apparatus, by the first contact portion to receive a force in an inserting direction in which said cartridge is mounted to said main assembly of the apparatus; a guide portion, rotatably supporting said shaft, for guiding said shaft such that movable member is rendered movable in the inserting direction by said second contact portion being pushed by the first contact portion when said cartridge is mounted to said main assembly of the apparatus; a link rotatably supporting said movable member to rotate said movable member by said second contact portion being pushed by the first contact portion when said cartridge is mounted to said main assembly of the apparatus, such that movable member is rotated about said shaft in a direction of electrically connecting said main assembly electrical contact to said cartridge electrical contact.

According to a further aspect of the present invention, there is provided a cartridge detachably mountable to an image forming apparatus, wherein said image forming apparatus includes a movable member having, a shaft, a main assembly electrical contact and an apparatus contact portion, a guide portion, rotatably supporting the shaft, for guiding the shaft such that movable member is rendered movable; wherein the movable member is supported so as to be rotatable about the shaft by the apparatus contact portion to be contacted being pushed, said cartridge comprising a storing element for storing information; a cartridge electrical contact electrically connected with said storing element; a first contact portion for causing the shaft to be guided by the guide portion to electrically connect the main assembly electrical contact to said cartridge electrical contact, by moving the movable member by contacting to the portion to be contacted when said cartridge is mounted to a main assembly of the apparatus of the image forming apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. However, the measurements, materials, shapes of the structural components, and the positional relationship among the structural components, in the following preferred embodiments of the present invention, are to be modified as necessary or as fit, according to the structure of an apparatus to which the present invention is applied, or various conditions under which the apparatus will be operated. That is, the following preferred embodiments are not intended to limit the present invention in scope, unless specifically noted.

Embodiment 1

Referring to FIGS. 1-5, the image forming apparatus in the first preferred embodiment of the present invention will be described. First, referring to FIG. 1, the process cartridge in this embodiment, and the image forming apparatus in which the process cartridge is removably mountable, will be described. Then, the storage means of the process cartridge, and the means for establishing an electrical connection between the main assembly of the image forming apparatus and a process cartridge will be described. Incidentally, this preferred embodiment will be described with reference to an electrophotographic laser beam printer.

Figure 1:
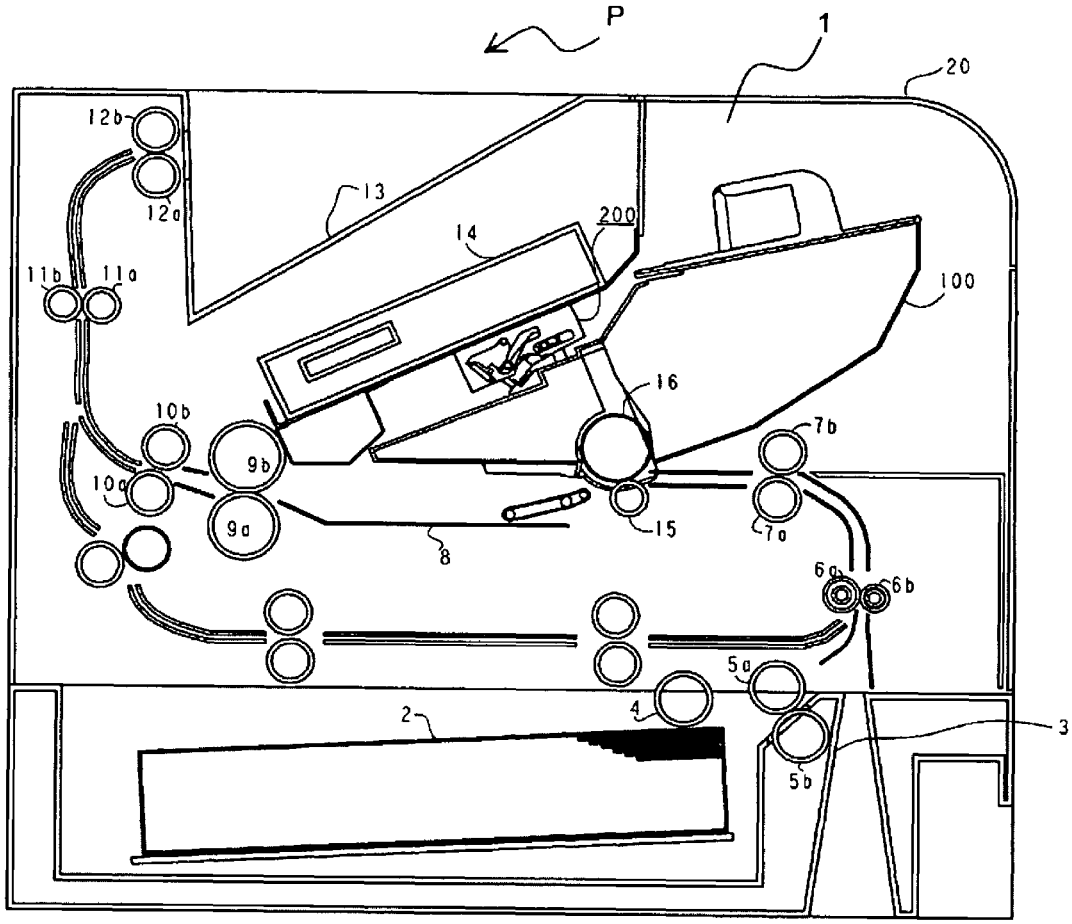
FIG. 1 is a schematic sectional view of the image forming apparatus in the first preferred embodiment of the present invention, showing the general structure of the apparatus.

Referring to FIG. 1, the main assembly 1 of the image forming apparatus has an optical system 14 (scanner) and an electrophotographic photosensitive member 16, which is in the form of a drum (which hereafter may be referred to simply as photosensitive drum). As for the operation of the image forming apparatus, first, it forms a latent image on the photosensitive layer of the photosensitive drum by scanning the peripheral surface of the photosensitive drum with the beam of laser light projected by the optical system while being modulated in accordance with the information of an image to be formed, and then, develops the latent image with the use of developer, into a visible image, that is, an image formed of developer.

The main assembly 1 has also a recording medium cassette 3, in which recording mediums 2, for example, sheets of recording paper, sheets for an OHP, sheets of fabric, etc., are stored. The recording mediums 2 are fed from the cassette 3 into the main assembly one by one by a pickup roller 4 and a pair of conveyance rollers 5*a* and 5*b*, and then, is conveyed further through the main assembly 1 by a pair of conveyance rollers 6*a* and 6*b*, and a pair of registration rollers 7*a* and 7*b*, in synchronism with the formation of the abovementioned visible image (formed of developer). Then, the visible image is transferred onto the recording medium 2 by applying voltage to a transfer roller 15, as an image transferring means, with which the apparatus main assembly 1 is provided. After the transfer of the visible image onto the recording medium 2, the recording medium 2 is conveyed to an image fixing means while being guided by a guiding plate 8. The fixing means 9 is made up of a driver roller 9*a*, and a fixation roller 9*b* having an internal heater. As the recording medium 2 is conveyed through the fixing means 9, heat and pressure is applied to the recording medium 2 and the visible image (unfixed image formed of developer) on the recording medium 2. As a result, the visible image becomes fixed to the recording medium 2. After the fixation of the visible image to the recording medium 2, the recording medium 2 is conveyed further, and is discharged into an external delivery tray 13, by a pair of discharge rollers 10*a* and 10*b*, a pair of discharge rollers 11*a* and 11*b*, and a pair of discharge rollers 12*a* and 12.

The process cartridge 100 has a photosensitive drum 16 and a minimum of one processing means. Processing means may be one or more of charging means for charging an electrophotographic photosensitive member, developing means for developing a latent image formed on an electrophotographic photosensitive member, cleaning means for removing the developer remaining on the peripheral surface of an electrophotographic photosensitive member, etc. (unshown).

Referring to FIG. 1, the process cartridge 100 is in its image forming position, that is, the position in which it can form images. The apparatus main assembly 1 is provided with a movable member unit 200 having a movable member. When the process cartridge 100 is in its image forming position in the apparatus main assembly 1, the movable member unit 200 is on the top side of the process cartridge 100, and also, the electrical contacts of the apparatus main assembly 1 are in contact with those of the process cartridge 100.

Figure 2:
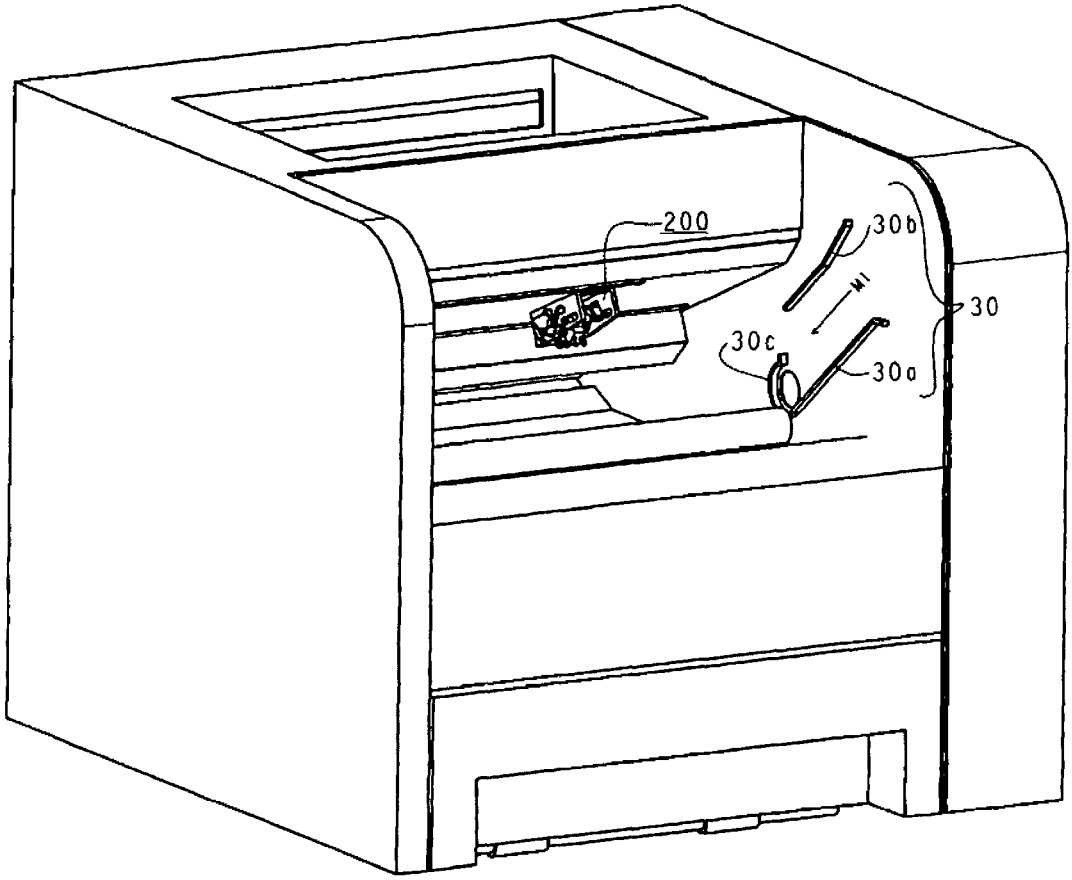
FIG. 2 is a schematic perspective view of the image forming apparatus, in the first preferred embodiment, the cover of which is open.

Next, referring to FIG. 2, the method for mounting the process cartridge 100 into the apparatus main assembly 1 will be described. FIG. 2 is a perspective view of the process cartridge compartment of the apparatus main assembly 1, the cover 20 of which is open.

As will be evident from FIG. 2, each of the left (which is not shown) and right walls of the cartridge compartment of the apparatus main assembly 1 is provided with a cartridge guide 30. The cartridge guide 30 has a pair of guiding portions 30*a* and 30*b*, which guide a process cartridge 100 while the cartridge 100 is inserted into the apparatus main assembly 1, and a cartridge positioning portion 30*c* for correctly positioning the process cartridge 100 for image formation in the apparatus main assembly 1. The cartridge positioning portion 30*c* is in connection to the guiding portion 30*a*.

The operation for mounting the process cartridge 100 into the apparatus main assembly 1 is as follows: First, the cartridge cover 20 (FIG. 1) is to be opened, and the process cartridge 100 is to be inserted into the apparatus main assembly 1. As the process cartridge 100 is inserted, it is regulated in its movement by the guiding portions 30*a* and 30*b*, and a pair of positioning bosses 100*a* which project from the lengthwise ends of the process cartridge 100 one for one. Since the process cartridge 100 is guided by the cartridge guides 30, it enters the apparatus main assembly 1 in the direction indicated by an arrow mark M1 in FIG. 2. The process cartridge 100 is moved inward of the apparatus main assembly 1 until the abovementioned pair of positioning bosses 100*a* fit into the cartridge positioning portions 30*c* of the apparatus main assembly 1, that is, until it is correctly positioned in its image forming position. Then, the cartridge cover 20 is closed to complete the operation for mounting the process cartridge 100 into the apparatus main assembly 1.

Figure 3:
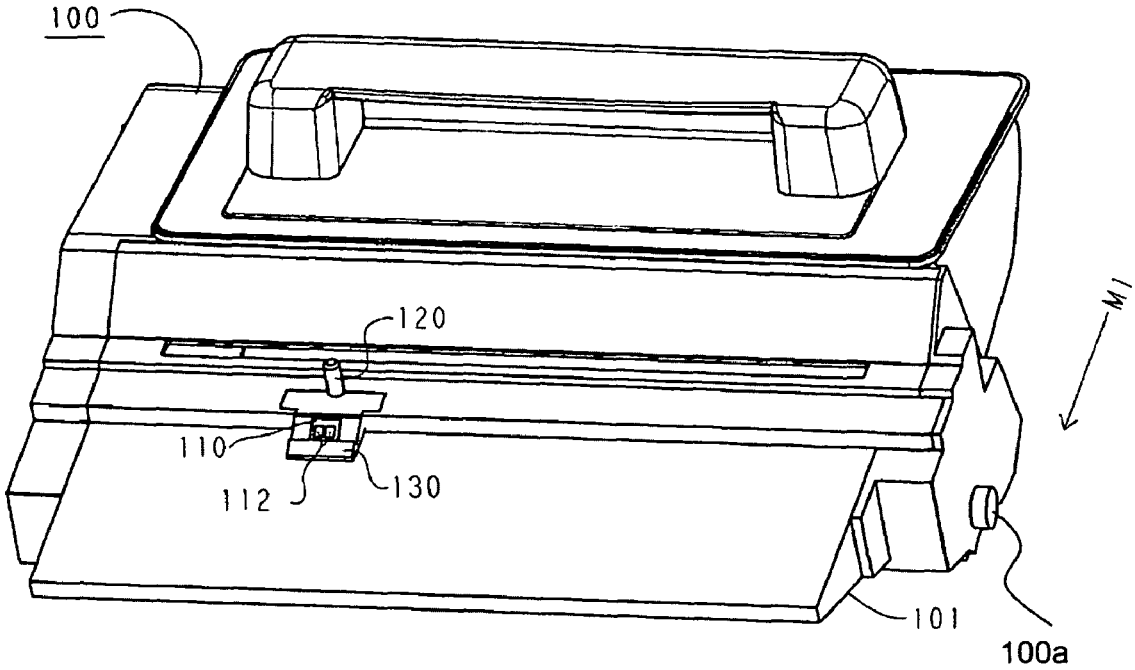
FIG. 3 is a schematic perspective view of the process cartridge in the first preferred embodiment of the present invention.

Next, referring to FIG. 3, the storage means and movable member contacting portion of the process cartridge 100, will be described.

The storage means 110 is on the top surface of the cartridge frame 101 of the process cartridge 100. The storage means 110 has a memory chip (unshown), which is a storage element, such as a RAM or ROM, for storing information. The memory chip is on the back surface of the storage means 110. The storage means 110 has also a pair of electrical contacts 112, that is, the electrical contacts on the cartridge side, which are on the top surface of the storage means 110. Incidentally, some storage means 110 have two sets of electrical contacts. The information necessary for the process cartridge 100 is stored in advance in the memory chip. After the mounting of the process cartridge 100 into the apparatus main assembly 1, information is exchanged between the process cartridge 100 and apparatus main assembly 1. More specifically, information such as the condition, usage history, etc., of the process cartridge 100 is sent to the control chip (controlling means) of the apparatus main assembly 1 to be used for image formation, and also, to display the condition of the process cartridge 100, and the like information, to an operator (user). The memory chip is of such a type that is writable even when it is in use, and therefore, the abovementioned information or the like can be written into the memory chip as necessary. As for the examples of the information to be stored in the memory chip, there are the lot number of the process cartridge 100, initial values set for the process cartridge 100, history of the usage of the process cartridge 100, properties of the image forming apparatus, properties of the processing means, etc.

The electrical contacts 112 of the process cartridge 100 is connected to the electrical contacts of the apparatus main assembly 1 to make it possible for the information in the memory chip to be read by the apparatus main assembly 100, and also, for information to be written in the memory chip. They are made of a plate of phosphor bronze, and are plated with gold.

The process cartridge 100 is provided with two contacting portions 120 and 130, which correctly position the movable member of the apparatus main assembly relative to the process cartridge 100 by coming into contact with the movable member. The movable member contacting portions 120 and 130 (which hereafter may be referred to simply as contacting portions 120 and 130) are on the top surface of the cartridge frame 101. The arrow mark M1 in FIG. 3 indicates the direction in which the process cartridge 100 is inserted into the apparatus main assembly 1. In terms of the direction in which the process cartridge 100 is inserted, the first contacting portion 120, which is in the form of a piece of round shaft, is on the upstream side relative to the electrical contacts 112. The first contacting portion 120 comes into contact with the movable member 220 (which will be described later) of the apparatus main assembly 1, and causes the movable member 220 to slide and rotate. Also in terms of the direction in which the process cartridge 100 is inserted into the apparatus main assembly 1, the second contacting portion 130, which is flat, is on the downstream relative to the first contacting portion 120. The second contacting portion 130 is the contacting portion with which the movable member 220 comes into contact by being pushed by the first contacting portion 120.

Figure 4:
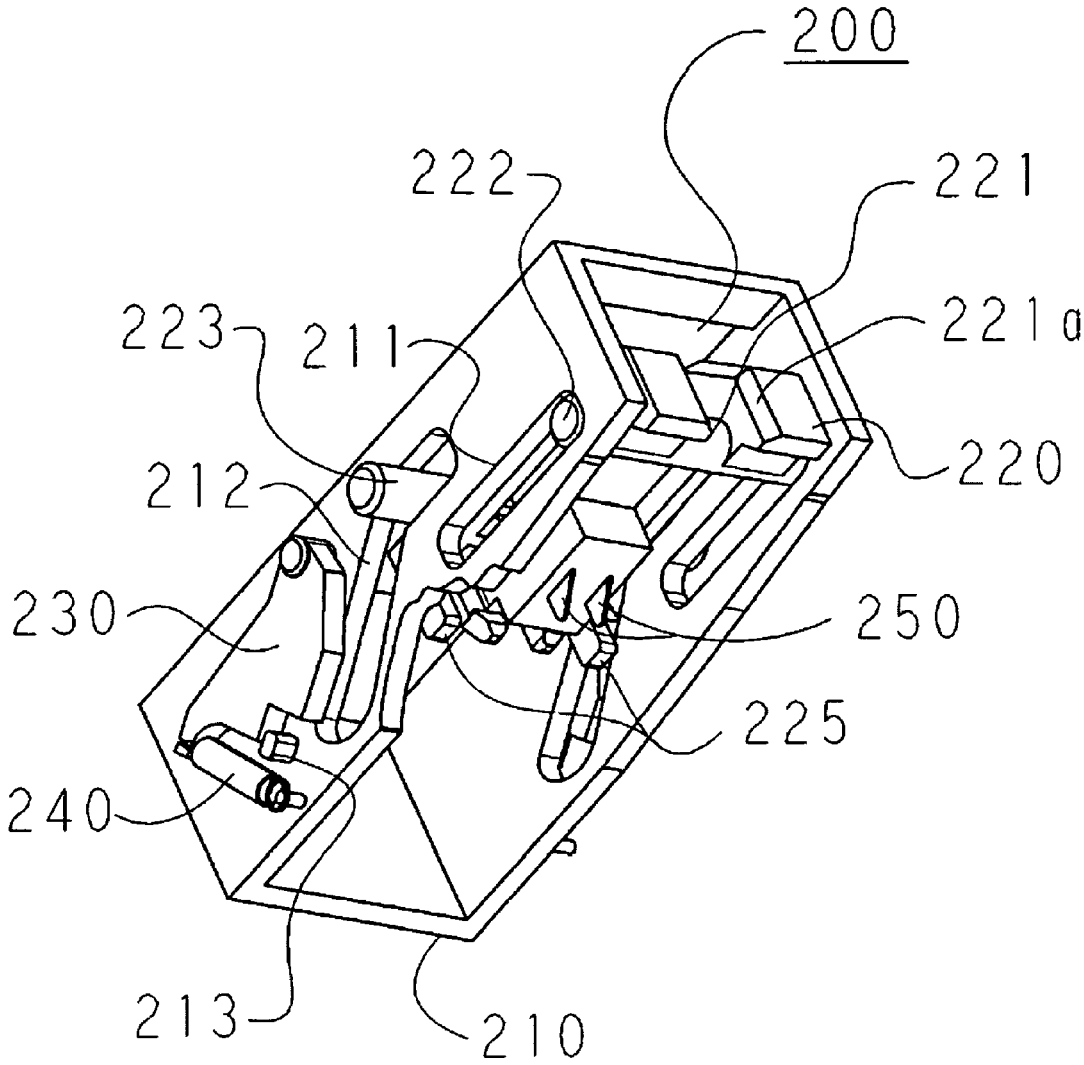
FIG. 4 is a schematic perspective view of the movable member unit in the first preferred embodiment of the present invention.

Next, referring to FIG. 4, the movable member unit 200 of the apparatus main assembly 1, which includes the movable member 220, will be described in detail. FIG. 4 is a perspective view of the movable member unit 200 when it is on standby (when process cartridge 100 is not in apparatus main assembly 1).

The movable member 220 has a pair of electrical contacts 250, which come into contact with the pair of electrical contacts 112 of the abovementioned storage means 110. The electrical contacts 250 connect with the control chip on the back side of the memory chip through lead wires (unshown). As the pair of electrical contacts 250 come into contact with the pair of electrical contacts 112, one for one, of the storage means 110, the control chip of the apparatus main assembly 1 communicates with the memory chip of the process cartridge 100 to obtain information such as the lot number of the process cartridge 100, properties of the image forming apparatus P, properties of the processing means, etc.

Further, the movable member 220 has a first positioning portion 221, a pair of second positioning portions 225, a pair of regulating shafts 222 (first shafts), and a pair of pressure catching shafts 223 (second shafts), in addition to the abovementioned pair of electrical contacts 250. The first positioning portion 221 is the positioning portion of the movable member, with which the movable member contacting first portion 120 of the process cartridge come into contact. It has a pair of slanted surfaces for guiding the first contacting portion 120 of the process cartridge 100. Next, each of the abovementioned portions of the movable member 220 will be described in detail.

The first positioning portion 221 is at the center of the upstream end of the movable member 220 in terms of the direction in which the process cartridge 100 is inserted. It is positioned so that it comes into contact, and engages, with the first contacting portion 120 of the process cartridge 100. The first positioning portion 221 controls the positional relationship between the process cartridge 100 and movable member 220 in terms of the cartridge insertion direction (indicated by arrow mark M1 in FIG. 3), and also, in terms of the width direction of the process cartridge 100, that is, the direction crossing with the cartridge insertion direction. The guiding surfaces 221*a* of the first positioning portion 221 guides the first contacting portion 120 during the insertion of the process cartridge 100.

The pair of second positioning portions 225 are for correctly positioning the movable member 220 in terms of its rotational direction of the movable member 220 by coming into contact with the movable member contacting second portion 130 of the process cartridge 100 after the first contacting portion 120 comes into contact with the first positioning portion 221.

The abovementioned regulating shafts 222 and pressure catching shafts 223 of the movable member 220 are supported by the lateral walls of the movable member 220. More specifically, each of the regulating shafts 222 is supported by the apparatus main assembly 1 in such a manner that it is allowed to slide and rotate relative to the apparatus main assembly 1. Further, each of the pressure catching shafts 223 is supported by the apparatus main assembly 1 in such a manner that it is allowed to slide relative to the apparatus main assembly 1, and also, that as it slides, it causes the movable member 220 to rotate about the regulating shafts 222. The regulating shaft 222 and pressure catching shaft 223 are in engagement with the slide regulating grooves 211 and rotation regulating grooves 212, respectively, with which the movable member movement regulating frame 210, which will be described later, is provided.

The movable member movement regulating frame 210 (which hereafter may be referred to simply as movement regulating frame 210) is a part of the apparatus main assembly 1, and supports the movable member 220 in such a manner that the movable member 220 is allowed to slide and rotate. Each of the lateral walls of the movable member movement regulating frame 210 are provided with the slide regulating hole 211 (first guiding portion) and slide-and-rotation regulating hole 212 (second guiding portion), supporting thereby the regulating shaft 222 and pressure catching shaft 223. More specifically, the slide regulating hole 211 supports the regulating shaft 222 in such a manner that the regulating shaft 222 is allowed to rotationally move, and also, that the movable member 220 is allowed to slide in the direction parallel to the direction in which the process cartridge 100 is inserted into the apparatus main assembly 1. The slide-and-rotation regulating hole 212 guides the pressure catching shaft 223 in such a manner that the movable member 220 is allowed to rotate about the rotational regulating shafts 222 toward the process cartridge 100. Further, the movable member movement regulating frame 210 is provided with a pair of pressing members 230 and a pair of compression springs 240, which are on both sides of the movement regulating frame 210, one for one, as are the pressure catching shafts 223, in terms of the direction crossing with the cartridge insertion direction.

In FIG. 4, the movable member 220 is in its standby position, in which it is not under the pressure from the pair of pressing members 230 and pair of compression springs 240. Further, the movable member unit 200 is provided with a pair of springs 224 for moving the movable member 220 from the normal position in which the movable member 220 remains when the process cartridge 100 is in its image forming position in the apparatus main assembly 1, back into the standby position.

Next, referring to FIGS. 5(*a*)-5(*d*), the movements of the movable member 220, which occur during the insertion of the process cartridge 100, will be described.

Figure 5:
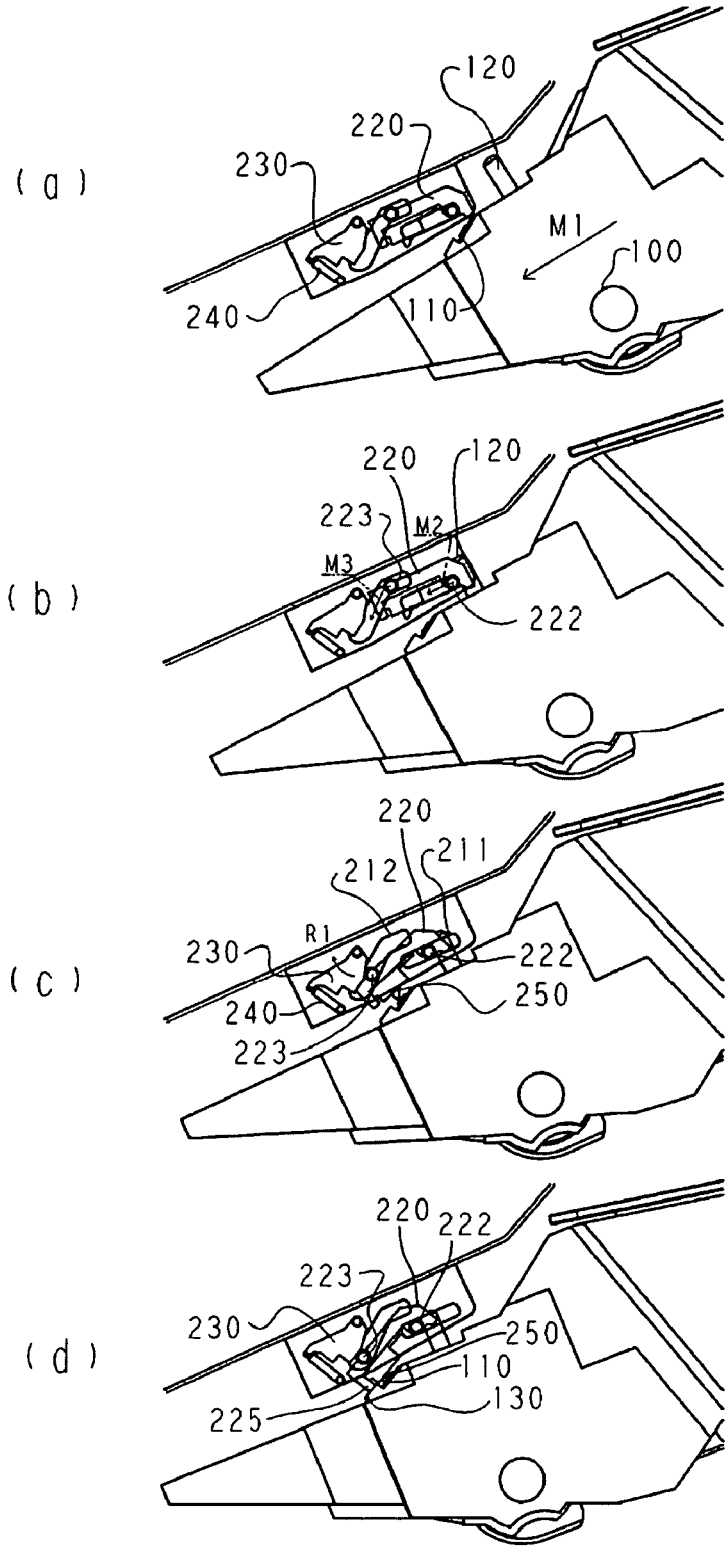
FIGS. 5(*a*)-5(*d*) are schematic drawings for showing the movements of the movable member in the first preferred embodiment.

FIG. 5(*a*) shows the movable member position in which the movable member 220 remains on standby before the insertion of the process cartridge 100 into the apparatus main assembly 1. When the movable member 220 is in this position, it is not in contact with the process cartridge 100. As the process cartridge 100 is inserted into the apparatus main assembly 1, it is guided in the direction indicated by the arrow mark M1 by the pair of guiding members 30 (FIG. 20).

Next, referring to FIG. 5(*b*), as the process cartridge 100 is inserted into the apparatus main assembly 1, the movable member contacting first portion 120 of the process cartridge 100 comes into contact with the first positioning portion 221 (FIG. 4) of the movable member 220. Then, as the process cartridge 100 is inserted further into the apparatus main assembly 1, the first contacting portion 120 is guided by the slanted guiding surfaces 221*a* (FIG. 4) of the first positioning portion 221, and comes into contact with the first positioning portion 221, correctly positioning the movable member 220 relative to the process cartridge 100 in terms of the direction parallel to the axial line of the photosensitive drum 16 (widthwise direction of process cartridge 100). In addition, the first positioning portion 221 is moved by the force applied thereto by the movable member contacting first portion 120 of the process cartridge 100, being thereby correctly positioned relative to the process cartridge 100 also in terms of the direction parallel to the cartridge insertion direction.

As a result, the movable member 220 becomes correctly positioned relative to the process cartridge 100 in terms of both the direction parallel to the cartridge insertion direction, and the widthwise direction of the process cartridge 100. Even though the process cartridge 100 is inserted further into the apparatus main assembly 1, the positional relationship between the process cartridge 100 and movable member 220 does not change from this point on.

Next, referring to FIGS. 5(*b*) and 5(*c*), interaction of the process cartridge 100 and movable member 220 as the process cartridge 100 is inserted further into the apparatus main assembly 1 after the occurrence of the contact between the process cartridge 100 and movable member 220 will be described. After the movable member contacting first portion 120 comes into contact with the movable member 220, the movable member 220 is pushed by the first contacting portion 120. As a result, each of the regulating shafts 222 is moved by the movable member 220. Since the movement of the regulating shaft 222 is regulated by the pair of regulating shaft movement regulating holes 211. Thus, the regulating shaft 222 moves in the direction indicated by an arrow mark M2. At the same time, each of the pressure catching shafts 223 is pushed by the movable member 220. Since the movements of the pressure catching shafts 223 are regulated by the pair of pressure catching shaft movement regulating holes 212. Thus, each of the pressure catching shafts 223 is moved in the direction indicated by an arrow mark M3. As a result, the movable member 220 is rotationally moved about the regulating shafts 220, toward the storage means 110 of the process cartridge 100.

As the pressure catching shafts 223 reach the position shown in FIG. 5(*c*), they come into contact with the pair of pressing members 230, beginning to be pressed toward the process cartridge 100 by the pair of compression springs 240.

FIG. 5(*d*) shows the normal process cartridge position in the apparatus main assembly 1. The movable member 220 having approached the storage means 110 while being rotationally moved about the regulating shafts 222 has come into contact with the second contacting portions 130 of the process cartridge 100, by its second positioning portions 225, being thereby correctly positioned in terms of the direction of its rotational movement.

As the movable member 220 is rotationally moved as described above, the pair of electrical contacts 250, that is, the electrical contacts on the main assembly side, approaches the storage means 110, together with the movable member 220. The pairs of electrical contacts on the main assembly side come into contact with the pair of electrical contacts on the process cartridge side, while being rotationally moved about the regulating shafts 222. Thus, the locus of the point of contact between each of the electrical contacts of the process cartridge 100 and the counterpart of the movable member 220 in terms of the direction indicated by the arrow mark M1 coincides with the local of the electrical contacts themselves. Therefore, each of the electrical contacts 112 (FIG. 3) of the storage means 110 may be very small in the area by which it comes into contact, and remains in contact, with the counterpart of the movable member 220.

Further, the pair of second positioning portions 225 come into contact with the second contacting portions 130 just to stop the rotation of the movable member 220. Thus, there is virtually no friction between the second positioning portions 225 and second contacting portion 130. Moreover, the movable member 220 is correctly positioned relative to the process cartridge 100 (electrical contacts of process cartridge) in the adjacencies of the regulating shafts 222, about which the movable member 220 is rotated, in terms of both the direction parallel to the cartridge insertion direction, and the direction crossing with the cartridge insertion direction. Therefore, the friction between the movable member 220 and process cartridge 100 is very small, making it unnecessary to employ strong springs to apply pressure to the terminal 112.

As described above, the movable member contacting first portion 120 of the process cartridge 100 engages with the first positioning portion 221 of the movable member 220 during the insertion of the process cartridge 100 into the apparatus main assembly 1 to correctly position the movable member 220 relatively to the process cartridge 100 in terms of the direction crossing with the cartridge insertion direction. Then, the movable member 220 is pushed by the movable member contacting first portion 120. As a result, the movable member 220 begins to rotationally move toward the process cartridge 100 while sliding in the direction parallel to the cartridge insertion direction. Then, the second positioning portions 225 of the movable member 220 come into contact with the second contacting portions 130 of the process cartridge 100, correctly positioning the movable member 220 in terms of the direction of the rotational movement of the movable member 220, and also, establishing electrical connection between the storage means 110 and the pair of electrical contacts 250 of the movable member 220, that is, the electrical contacts of the apparatus main assembly 1.

That is, the above described setup makes it possible to significantly reduce in length the locus of the point of contact between each of the electrical contacts of the storage means 110 and the counterpart of the apparatus main assembly 1 (movable member 220), making it therefore possible to significantly reduce the size of the electrical contacts 112. This is possible because the movable member 220 comes directly in contact with the process cartridge 100, and therefore, the movable member 220 is correctly positioned relative to the process cartridge 100, compared to a conventional setup. Further, in terms of the direction in which the movable member 220 is slidably moved relative to the process cartridge 100, the movable member 220 is correctly positioned relative to the process cartridge 100 by the regulating shaft 222, which functions as the rotational axle for the movable member 220. Therefore, the effect of the compression springs 240 upon the movable member 220 is small. Therefore, the friction between the movable member 220 and process cartridge 100 is very small. Moreover, even if the electrical contacts are plated with gold to establish reliable electrical connection, the cost for the plating is significantly smaller than that in accordance with the prior art, because the electrical contacts are significantly smaller than those in accordance with the prior art, because the electrical contacts of the process cartridge 100 in this embodiment is significantly smaller than those in accordance with the prior art.

Embodiment 2

Next, referring to FIGS. 6-9, the image forming apparatus P in the second preferred embodiment will be described. In terms of the shape of the movable member of the apparatus main assembly, and the shape of the process cartridge, the image forming apparatus P in this embodiment is similar to the image forming apparatus in the first embodiment. Thus, only the structural features of the image forming apparatus P in this embodiment, which are different from the counterparts of the image forming apparatus in the first embodiment, will be described; the structural features of the image forming apparatus in this embodiment, which are similar to the counterparts in the first embodiment, will not be described. Further, the components of the image forming apparatus P in this embodiment, which are the same as the counterparts in the first embodiment, will be given the same referential codes, one for one, as those given to the counterparts.

In this embodiment, the movable member contacting first portion 140 of the process cartridge 100 has three pairs of positioning portions, that is, a pair of positioning portions 140*a*, a pair of positioning portions 140*b*, and a pair of positioning portions 140*c*. In terms of the direction crossing with the direction in which the process cartridge 100 is inserted into the apparatus main assembly, one of the two positioning portions of each pair is on one end of the first contacting portion 140, and the other is on the other end. Further, the regulating shafts (first shafts) double as the first positioning portions 322 of the movable member. More specifically, each end of the regulating shaft extends beyond the corresponding lateral wall of the movable member movement regulating frame 210, functioning as the first positioning portion 322. In other words, there are two first positioning portions 322, which are on one side of the movable member, and the other, one for one, in terms of the direction parallel to the axial line of the regulating shaft. Next, this setup will be described in detail.

Figure 6:
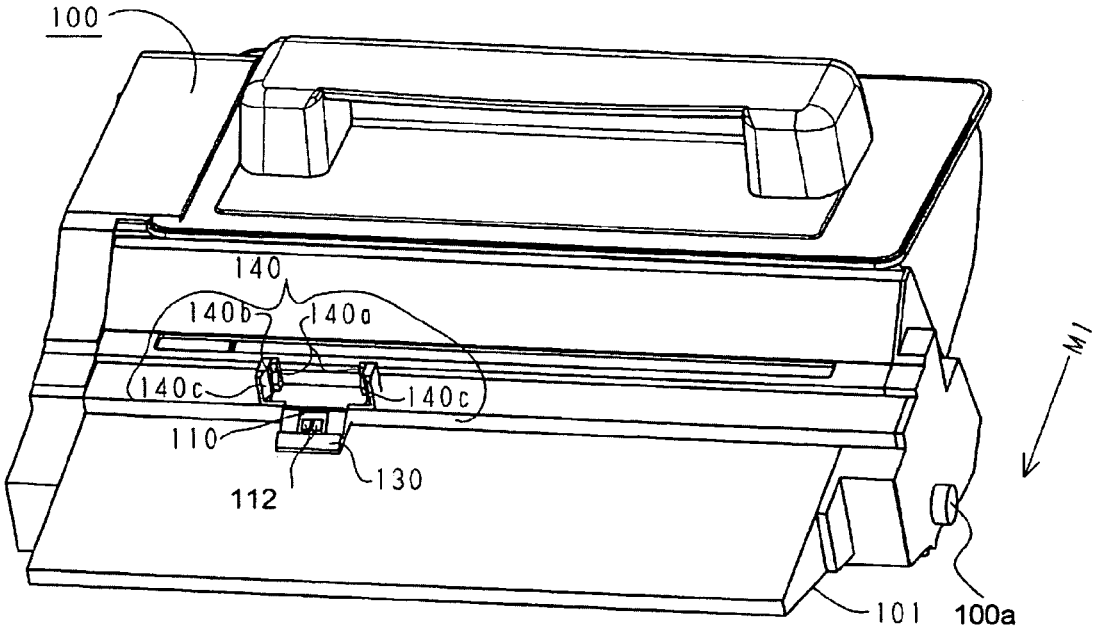
FIG. 6 is a schematic perspective view of the process cartridge in the second preferred embodiment of the present invention.

First, referring to FIG. 6, the shape of the first contacting portion 140 of the process cartridge 100 in this embodiment, which is different from that in the first embodiment, will be described. The shape of the second contacting portion 130 and the shape of the electrical contacts 112 of the cartridge 100, are the same as the counterparts in the first embodiment.

In terms of the cartridge insertion direction, the positioning portions 140*a*, 140*b*, and 140*c* of the first contacting portion 140 of the process cartridge 100 are on the upstream side relative to the electrical contacts 112 of the storage means 110. In terms of the direction crossing with the cartridge insertion direction, the three pairs of positioning portions of the first contacting portion 140 are on one side of the electrical contacts 112 and the other, one for one. The pair of positioning portions 140*a* of the first contacting portion 140 are used to correctly position the electrical contacts 250 of the apparatus main assembly in terms of the widthwise direction of the process cartridge 100. The pair of portion 140*b* of the first contacting portion 140 are used for correctly positioning the electrical contacts 250 of the apparatus main assembly 1 in terms of the cartridge insertion direction. The pair of positioning portions 140*c* of the first contacting portion 140 are used for guiding the movable member 320 in terms of the widthwise direction of the process cartridge 100 during the insertion of the process cartridge 100 into the apparatus main assembly.

Figure 7:
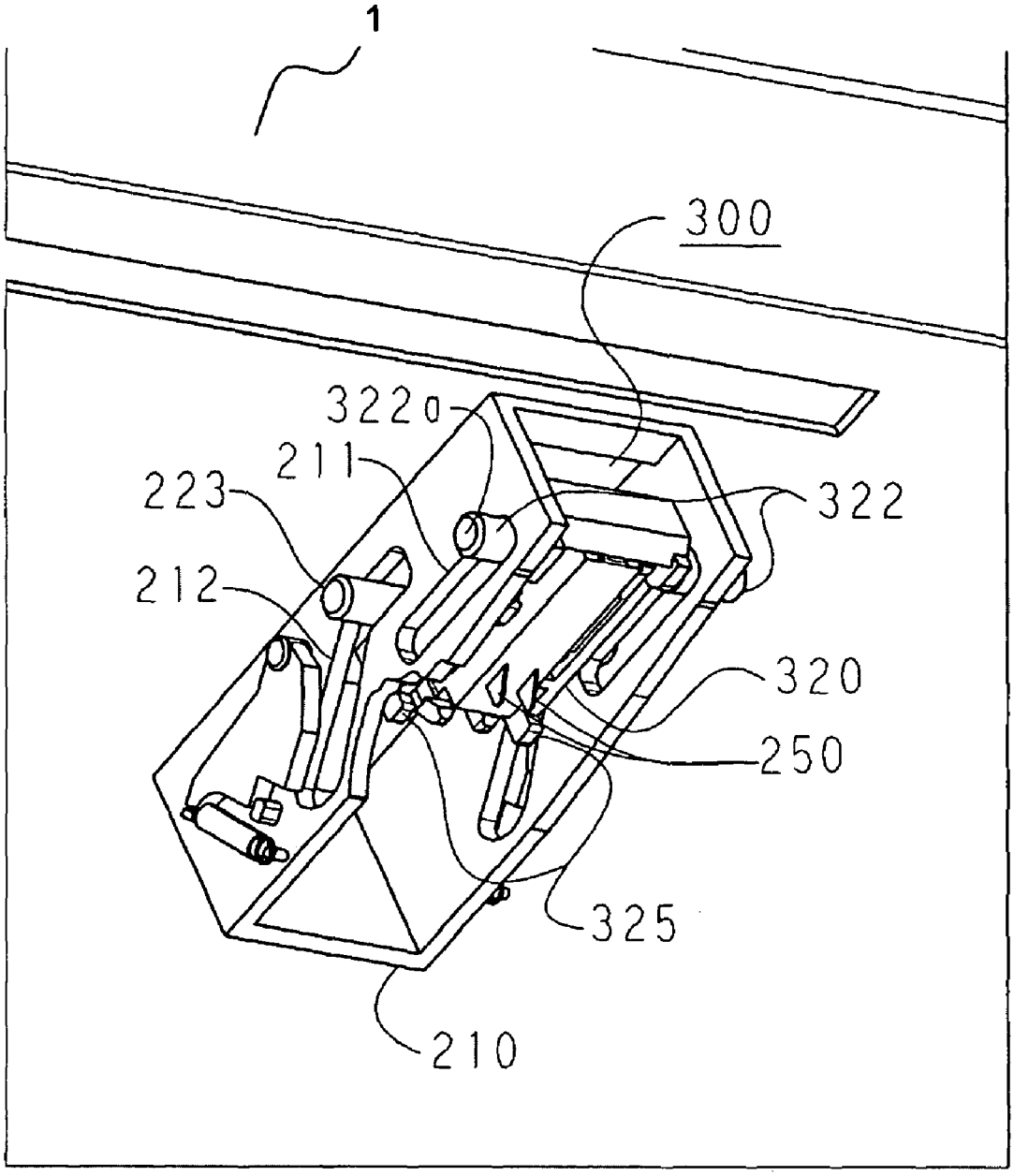
FIG. 7 is a schematic perspective view of the movable member unit in the second preferred embodiment of the present invention.

Next, referring to FIG. 7, the structure of the movable member unit 300 of the apparatus main assembly 1, which includes the movable member 320, will be described in detail. FIG. 7 shows the movable member unit 300, which is on standby, that is, the state of the unit 300 before the process cartridge 100 is inserted into the apparatus main assembly 1.

The movable member 320 is provided with a pair of first positioning portions 322, one of which is one side of the movable member 320, and the other of which is on the other side of the movable member 320, in terms of the direction crossing with the cartridge insertion direction. Each of the pair of first positioning portions 322 is positioned in such a manner that as the process cartridge 100 is inserted into the apparatus main assembly, it engages with the first contacting portion 140 of the process cartridge 100. The two first positioning portions 322 correctly position the movable member 320 relative to the process cartridge 100 in terms of both the direction parallel to the cartridge insertion direction (indicated by arrow mark M1 in FIG. 6) and the direction crossing with the cartridge insertion direction (indicated by arrow mark M1 in FIG. 6). The first positioning portions 322 are the lengthwise extensions of the first shaft which is supported by the apparatus main assembly 1 (movable member movement regulating frame 210) in such a manner that it is allowed to slide as well as rotate relative to the apparatus main assembly 1 (movable member movement regulating frame 210).

In terms of the direction indicated by the arrow mark M1, that is, the direction parallel to the cartridge insertion direction, the movable member 320 is correctly positioned relative to the process cartridge 100 by the peripheral surfaces of the pair of first positioning portions 322, and the pair of positioning portions 140*a* of the first contacting portion 140 of the process cartridge 100. In terms of the direction crossing with the direction indicated by the arrow mark M1, the movable member 320 is correctly positioned relative to the process cartridge 100 by the end surfaces 322*a* of the pair of first positioning portions 322 and the pair of positioning portions 140*b* of the first contacting portion 140 of the process cartridge 100.

Next, referring to FIGS. 8(*a*) and 8(*b*), the movements of the movable member 320, which occur during the insertion of the process cartridge 100, will be described.

Figure 8:
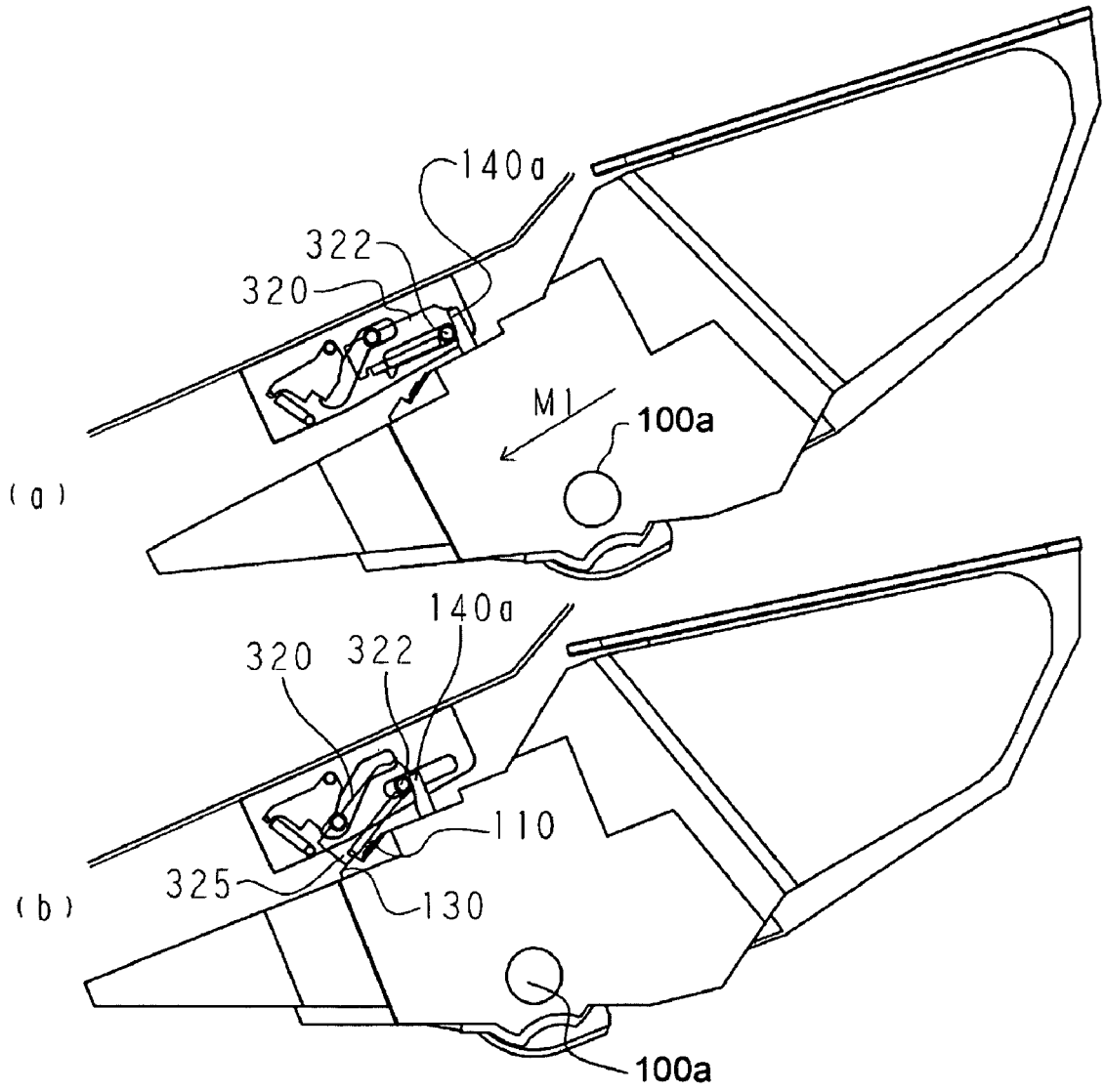
FIGS. 8(*a*) and 8(*b*) are schematic drawings for showing the movements of the movable member in the second preferred embodiment.

FIG. 8(*a*) shows the pair of first positioning portions 140*a* of the first contacting portion 140, and the pair of first positioning portions 322 of the movable member 320 right after the former have come into contact with the latter during the insertion of the process cartridge 100 into the apparatus main assembly 1. At this point in time during the insertion of the process cartridge 100, the pair of first positioning portions 140*a* of the first contacting portion 140 of the process cartridge 100 are in contact with the peripheral surfaces of the pair of first positioning portions 320 of the movable member 320, and therefore, the movable member 320 is correctly positioned relative to the process cartridge 100 in terms of the direction indicated by the arrow mark M1. At the same time, the pair of positioning portions 140*b* (FIG. 6) of the first contacting portion 140 of the process cartridge 100 come into contact with the end portions (end surfaces) of the first positioning portions 322, and therefore, the movable member 320 is correctly positioned relative to the process cartridge 100, in terms of the widthwise direction of the process cartridge 100 (direction crossing with direction indicated by arrow mark M1). Although FIG. 8 shows only one side of the movable member 320, the movements of the movable member 320, which occur on the other side of the movable member 320 during the cartridge insertion, are the same as those described above.

In other words, the movable member 320 is correctly positioned relative to the process cartridge 100 in terms of both the direction parallel to the cartridge insertion direction indicated by the arrow mark direction M1, and the direction crossing with the cartridge insertion direction, as the process cartridge 100 is inserted into the position shown in FIG. 8(*a*). During the further insertion of the process cartridge 100 into the apparatus main assembly 1, the positional relationship between the process cartridge 100 and movable member 320 does not change.

The movements of the movable member 320 in this embodiment, which occur after it comes into contact with the process cartridge 100, are the same as the movements of the movable member 220 in the first embodiment, which occur after the movable member 220 comes into contact with the process cartridge 100. To describe briefly, the movable member 320 slides in the cartridge insertion direction, and then, rotates about the first positioning portions 322, as which the first regulating shafts double, toward the storage means 110, while sliding in the cartridge insertion direction, by being pushed by the first contacting portion 140. Then, the pair of second positioning portions 325 come into contact with the second contacting portion 130 of the process cartridge 100, whereby the movable member 320 is correctly positioned in terms of its rotational direction, as shown in FIG. 8(*b*).

Figure 9:
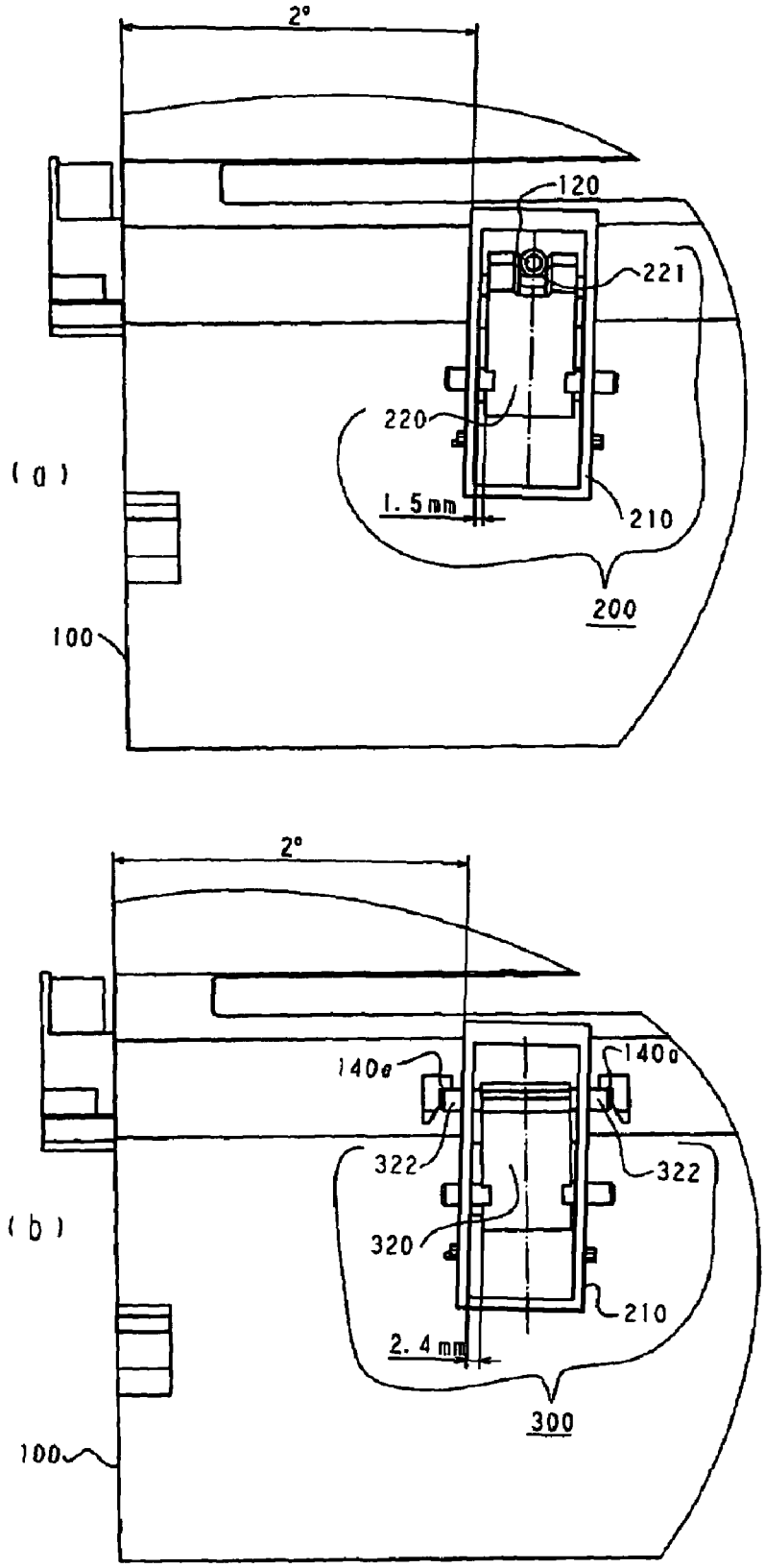
FIGS. 9(*a*) and 9(*b*) are schematic plan views of the movable member and process cartridge, in the second preferred embodiment of the present invention, showing their relationship.

Next, referring to FIGS. 9(*a*) and 9(*b*), the movements of the movable member 320 in this embodiment, which characterize this embodiment, will be described. FIG. 9(*a*) is a schematic plan view of the movable member unit 200 and process cartridge 100, in the first preferred embodiment of the present invention, as seen from their top side, showing their relationship during the insertion of the process cartridge 100 into the apparatus main assembly 1. In this case, the process cartridge 100 is slightly tilted (roughly two degrees) relative to the direction in which the process cartridge 100 is inserted into the apparatus main assembly 1. This slight tilting of the process cartridge 100 is unavoidable because of the presence of a gap between the wall of the cartridge compartment of the apparatus main assembly 1, and the process cartridge 100, in terms of the widthwise direction of the process cartridge 100. The amount of the angle of the tilting of the process cartridge 100 is likely to be greater during the initial stage of the insertion.

In terms of the cartridge insertion direction, the movable member 220 is correctly positioned relative to the process cartridge 100 by the first contacting portion 120 of the process cartridge 100. That is, it is only by the center portion of the process cartridge that is the movable member 220 is correctly positioned relative to the process cartridge 100 in terms of the cartridge insertion direction. Thus, the movable member 220 moves in parallel to the movable member movement regulating frame 210. When the movable member 220 is in the position shown in FIG. 9(*a*), it has begun to move while remaining tilted roughly 2 degrees relative to the process cartridge 100.

FIG. 9(*b*) is a schematic plan view of the cartridge 100 and movable member unit 300, in the second preferred embodiment, as seen from their top side, showing their relationship during the insertion of the process cartridge 100 into the apparatus main assembly 1. In this case, the movable member 320 has been positioned relative to the process cartridge 100 only by the two positioning portions 140*a* of first contacting portion 140 of the process cartridge 100 in terms of the cartridge insertion direction, and therefore, it is moving, while remaining tilted roughly two degrees as is the process cartridge 100, which will be evident from the drawing.

FIGS. 9(*a*) and 9(*b*) show the gaps between the moving members 220 and 320 and the movable member movement regulating frame 210, respectively. If the angle of the process cartridge 100 in FIG. 9(*a*) and the angle of the process cartridge 100 in FIG. 9(*b*) are the same, the abovementioned gap in the first embodiment is 1.5 mm, where as the gap in the second embodiment is 2.4 mm. That is, there is 0.9 mm of difference between the positional deviation of the movable members 220 and that of the movable member 320 in terms of the widthwise direction of the process cartridge 100. The storage means 110 and the electrical contacts 250 of the apparatus main assembly 1 are near the downstream end of the movable members 220 and 320. Therefore, even in the adjacencies of the point of contact between the electrical contacts of the storage means 110 and the electrical contacts 250 of the apparatus main assembly 1, the amount of the positional deviation of the movable member 220 in the first embodiment, in terms of the widthwise direction of the process cartridge 100, is larger by roughly 0.9 mm than that of the movable member 320 in the second embodiment.

By the time the process cartridge 100 is moved into its normal image forming position in the apparatus main assembly 1, the angle of the process cartridge 100 becomes zero, and so does the positional deviation. However, during the cartridge insertion, the angle does not become zero. The contact between the storage means 110 and the electrical contacts 250 of the apparatus main assembly 1 begins while the process cartridge 100 is being inserted into the apparatus main assembly 1. Thus, in the case of the first embodiment, the electrical contacts of the storage means 110 has to be made greater in the widthwise direction of the process cartridge 100 by the abovementioned positional deviation of its movable member 220. In the case of the second embodiment, however, this is unnecessary because the angle of the movable member 320 conforms to the angle of the process cartridge 100.

As described above, the first contacting portion 140 of the process cartridge 100 is provided with two positioning portions 140*a*, which are at the lengthwise ends of the first contacting portion 140, one for one, in terms of the widthwise direction of the process cartridge 100, and the first positioning portion 322 of the movable member 320 is provided two positioning portions 322*a*, which are the lengthwise end surfaces, one for one, of the regulating shafts, in terms of the widthwise direction of the process cartridge 100. Thus, the movable member 320 having the electrical contacts 250 of the apparatus main assembly 1 is correctly positioned relative to the process cartridge 100, in terms of both the direction in which the process cartridge 100 is inserted into the apparatus main assembly 1, and the direction crossing with the cartridge insertion direction, even while the process cartridge 100 is being inserted. In addition, during the cartridge insertion, the movable member 320 remains tilted at the same angle as the process cartridge 100, making it therefore possible to reduce in dimension the electrical contacts 112 of the storage means 110 not only in terms of the direction parallel to the cartridge insertion direction, but also, the direction crossing with the cartridge insertion direction, that is, the widthwise direction of the electrical contacts 112. That is, this embodiment can further reduce in size the electrical contacts 112 compared to the first embodiment.

Embodiment 3

Figure 10:
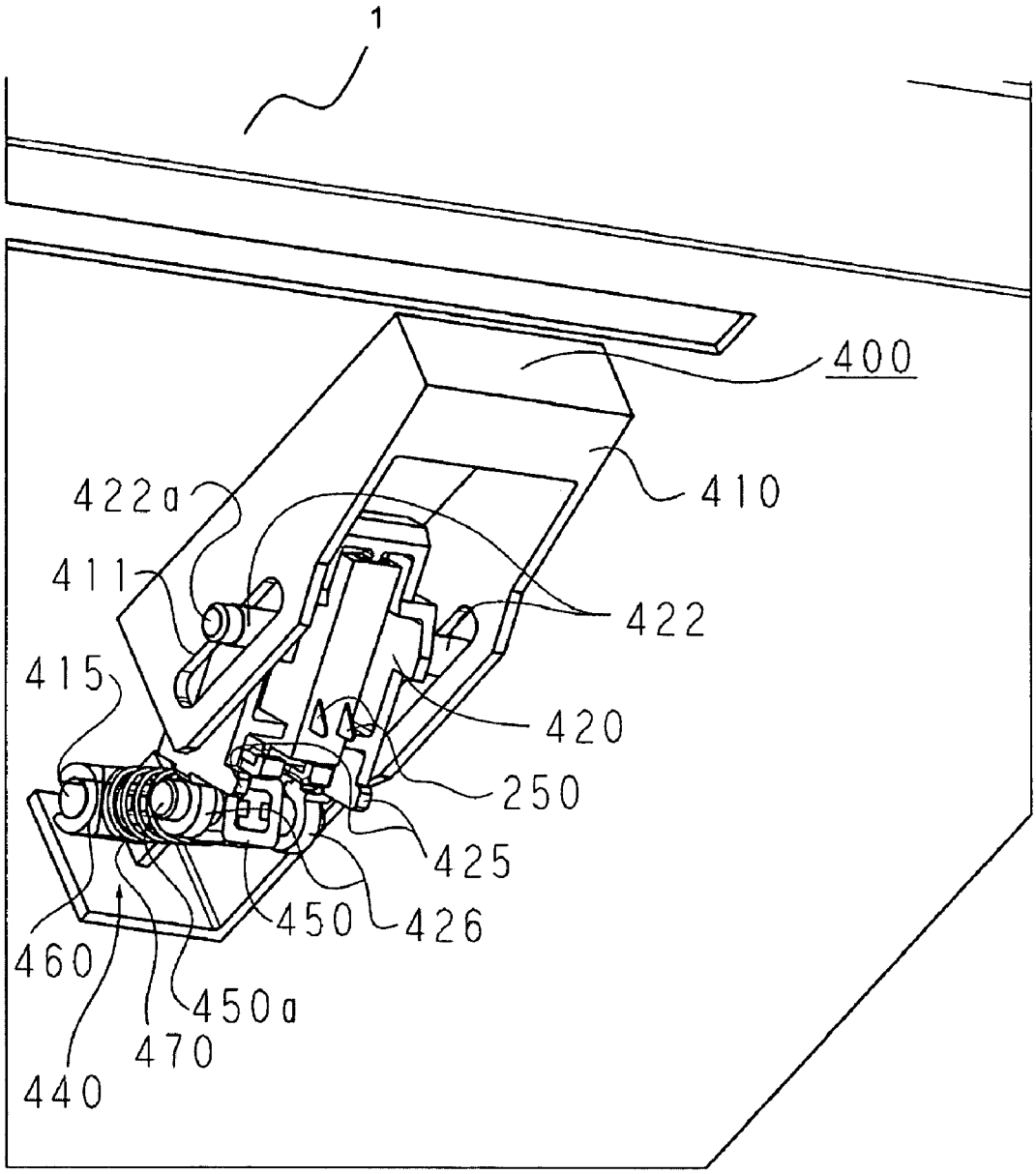
FIG. 10 is a schematic perspective view of the movable member unit in the third preferred embodiment of the present invention.

Next, referring to FIGS. 10 and 11, the image forming apparatus P in the third preferred embodiment of the present invention will be described. The process cartridge 100 in this embodiment is the same in shape and structure as that in the second embodiment described above. The components of the image forming apparatus P in this embodiment, which are the same as the counterparts in the first and second embodiments, are given the same referential codes, and will not be described.

First, referring to FIG. 10, the movable member unit 400 in this embodiment, which includes the movable member 420, will be described in detail regarding its structure. FIG. 10 shows the movable member 420 which is reacting to the push from the process cartridge 100 during the insertion of the process cartridge 100 into the apparatus main assembly 1.

The movable member 420 has a pair of first positioning portions 422, a pair of second positioning portions 425, and a pair of linking member supporting portions 426. One of the two first positioning portions 422 is on one side of the movable member 420, and the other is on the other side. They are positioned in such a manner that as the process cartridge 100 is inserted into the apparatus main assembly 1, they engage with the two positioning portions of the first contacting portion 140 of the process cartridge 100. The first positioning portion 422 correctly positions the movable member 420 relative to the process cartridge 100 in terms of both the direction parallel to the cartridge insertion direction (indicated by arrow mark M1 in FIG. 11), and the direction crossing with the cartridge insertion direction. More specifically, the first positioning portions 422 are the end portions of regulating shafts, one for one, which are supported by the movable member movement regulating frame 410 of the movable member unit 400 in such a manner that it is allowed to rotate, and also, linearly move, relative to the apparatus main assembly 1 (regulating frame 410). That is, the first positioning portions 422 are the two lengthwise ends, one for one, of the regulating shafts. More specifically, the regulating shafts, the lengthwise ends of which are the two first positioning portions 422, are fitted in a pair of regulating shaft movement regulating grooves 411, with which the two lateral walls of the movable member movement regulating frame 410 are provided one for one, and which are for regulating the direction in which the movable member 420 is linearly moved relative to the apparatus main assembly 1.

The position of the movable member 420 relative to the process cartridge 100 in terms of the direction parallel to the cartridge insertion direction indicated by the arrow mark M1 is set by the combination of the peripheral surfaces of the two first positioning portions 422 and the two positioning portions 140*a* of the first contacting portions 140 of the process cartridge 100. The position of the movable member 420 in terms of the direction crossing with the cartridge insertion direction indicated by the arrow mark M1 is set by the combination of the two first positioning portions 422 (end surfaces 422*a* of regulating shafts) and the two positioning portions 140*b* of the first contacting portion 140 of the process cartridge 100.

Further, the movable member unit 400 has a pair of linking members 440, which act upon the abovementioned linking member supporting points 420 in such a direction that the movable member 420 rotates about the first positioning portions 422 (regulating shafts) toward the storage means 110.

Each linking member 440 has an arm portion 460, a slidably movable portion 450, and a compression spring 470.

The arm portion 460 is rotatably attached to the apparatus main assembly 1 by one of its lengthwise ends (first end); it is fitted around a shaft, with which the movable member movement regulating frame 410 is provided. The other end (second end) of the arm portion 460 is provided with a slidably movable member 450, which is enabled to slide along the linking member 440. The slidable movable member 450 is kept pressured by the compression spring 470, which is fitted around the arm portion 460, in the direction to move away from one of the lengthwise ends of the arm portion 460, by which the linking member 440 is attached to the movable member movement regulating frame 410. The compression spring 470 is the member for keeping the slidably movable member 450 pressured toward the second end of the arm portion 460. The arm portion 460 is provided with a stopper (unshown), and the slidably movable portion 450 is kept pressed upon the stopper of the arm portion 460, remaining stationary relative to the arm portion 460, by being pressured by the compression spring 470. This structural arrangement makes it possible for the slidably movable portion 450, compression spring 470, and arm portion 460 to rotate together while remaining engaged with each other.

The slidably movable portion 450 is provided with a pair of short shafts 450*a*, which project from the lateral surfaces of the slidably movable portion 450, one for one. Each of the linking member supporting portions 426 of the movable member 420 is rotatably fitted around the corresponding shaft 450*a* of the slidably movable portion 450.

That is, the movable member 420, and three other portions, that is, the arm portion supporting portion 415, linking member supporting portion 460, and first positioning portion 422, make up a linkage. Thus, the locus of the movable member 420 is set by this linkage.

Next, referring to FIG. 11, the locus (movement) of the movable member 420 and the movement of the linkage will be described.

Figure 11:
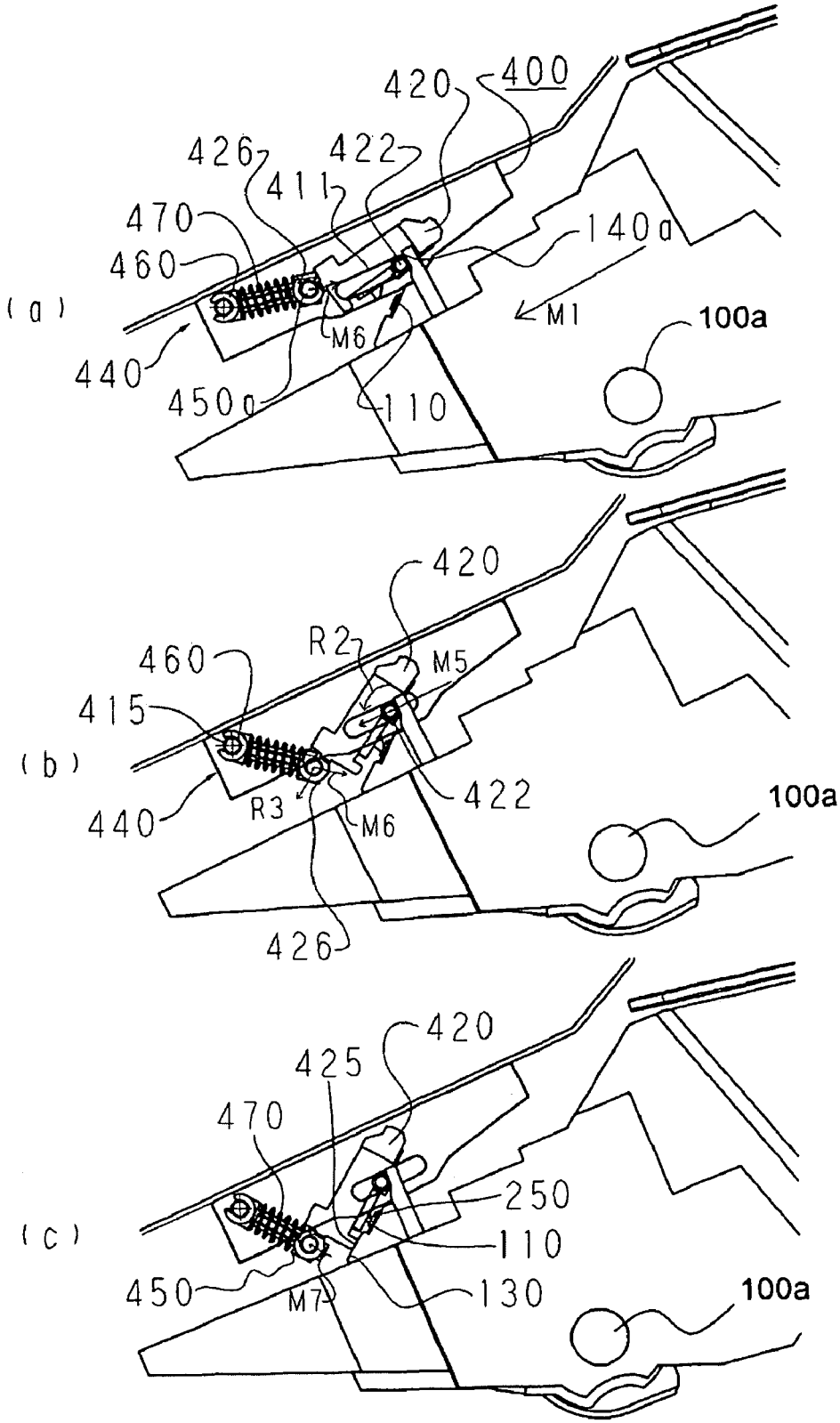
FIGS. 11(*a*)-11(*c*) are schematic drawings for showing the movements of the movable member in the third preferred embodiment.

FIG. 11(*a*) is a schematic drawing for showing the process cartridge 100 and the movable member 420 at the moment when the first contacting portion 140*a* of the process cartridge 100 has just come into contact with the first positioning portions 422 of the movable member 420. At this point during the insertion of the process cartridge 100, the positioning of the movable member 420 relative to the process cartridge 100 in terms of both the direction parallel to the cartridge insertion direction, and the direction crossing with the cartridge insertion direction, has just ended, as described above. When the process cartridge 100 and movable member 420 are in the state shown in FIG. 11(*a*), the slidably movable portion 450 is not pressed upon the stopper (unshown). The movable member 420 is being pressed in the direction indicated by an arrow mark M6 by the pressure applied by the compression spring 470 through the slidably movable portion 450, and the first positioning portion 422 is in contact with the upstream end (in terms of cartridge insertion direction) of the movable member movement regulating hole 411 of the regulating frame 410, which is for controlling the moving direction of the first positioning portion 422. The movable member 420 remains on standby in this state shown in FIG. 11(*a*). That is, in this embodiment, the movable member 420 is moved into its standby position by the force generated by the compression springs 470, as described above. Therefore, this embodiment does not require such springs as those in the preceding embodiments described above, which are dedicated to the returning of the movable members 220 and 320 to their standby positions, are not necessary in the case of this embodiment.

FIG. 11(*b*) is a schematic drawing for showing the process cartridge 100 and the movable member 420 at the moment when the first contacting portion 140*a* of the process cartridge 100 has begun to be made to slide in the movable member movement regulating hole 411 in the direction indicated by an arrow mark M5, by the further insertion of the process cartridge 100. As is evident from the drawing, the movable member 420 has begun to be rotated about the first positioning portion 422 in the direction indicated by an arrow mark R2 by the linkage, with which the movable member 420 is attached to the movable member movement regulating frame 410 while remaining in contact with the linking member 440. Then as the process cartridge 100 is inserted further, the slidably movable portion 450 of the linking member 440 slides in the direction indicated by the arrow mark M6 until it comes into contact with the stopper.

Then, as the process cartridge 100 is inserted even further, the second positioning portion 425 of the movable member 420 comes into contact with the second contacting portion 130 of the process cartridge 100, whereby the movable member 420 is correctly positioned relative to the process cartridge 100 in terms of its rotational direction of the movable member 420.

FIG. 11(*c*) is a schematic drawing of the process cartridge 100 and movable member 420 after the process cartridge 100 has been moved into the normal image forming position in the apparatus main assembly 1. When the process cartridge 100 is in the position shown in FIG. 11(*c*), the slidably movable portion 450 has been moved in the direction indicated by an arrow mark M7 by being pushed by the movable member 420. As a result, the movable member 420 is under the pressure (reactive force) generated by the compression spring 470 in the direction opposite to the direction indicated by the arrow mark M7, being thereby kept pressed toward the process cartridge 100. Therefore, it is ensured that satisfactory electrical connection is maintained between the storage means 110 and the electrical contacts of the apparatus main assembly 1.

As described above, also in this embodiment, the first contacting portion 140 of the process cartridge 100 is provided with two positioning portions 140*a*, which are at the ends, one for one, of the first contacting portion 140 in terms of the direction crossing with the cartridge insertion direction, and the movable member 420 is provided with two first positioning portions 422*a*, which are at the ends of the movable member 420 in terms of the direction crossing with the cartridge insertion direction. Thus, the movable member 420 having the electrical contacts 250 of the apparatus main assembly 1 is correctly positioned relative to the process cartridge 100, in terms of both the direction in which the process cartridge 100 is inserted into the apparatus main assembly 1, and the direction crossing with the cartridge insertion direction, even while the process cartridge 100 is being inserted into the apparatus main assembly 1. In addition, during the cartridge insertion, the movable member 420 is allowed to remain tilted at the same angle as the process cartridge 100, making it therefore possible to reduce in dimension the electrical contacts 112 of the storage means 110 not only in terms of the direction parallel to the cartridge insertion direction, but also, the direction crossing with the cartridge insertion direction, that is, the widthwise direction of the electrical contacts 112. That is, this embodiment can further reduce in size the electrical contacts 112 compared to the preceding embodiments.

Further, in this embodiment, the movement of the movable member is controlled by the linkage which is made up of the movable member and the three other portions as described above. Therefore, the movable member unit does not require the springs for keeping the movable member in its standby position. Thus, this embodiment can further reduce the amount of load to which the process cartridge is subjected.

Further, the first positioning portion 422 of the movable member 420 is provided with two positioning portions, which are at the ends of the first positioning portion 422, one for one, in terms of the direction crossing with the direction in which the process cartridge 100 is inserted into the apparatus main assembly 100. This setup, however, is not intended to limit the present invention in scope. For example, the first positioning portion 422 may be provided only one positioning portion as is the first positioning portion 222 in the first embodiment. That is, even if the first positioning portion 422 is provided with only one positioning portion proper, which is located at the center of the first positioning portion 422 in terms of the widthwise direction of the first positioning portion, the electrical contacts of the process cartridge can be reduced in size by reducing the length of the locus of the point of contact between each of the electrical contact of the movable member and the counterpart of the process cartridge.

According to the present invention, it is possible to reduce in size the electrical contacts of a process cartridge by reducing in length the locus of the point of contact between each of the electrical contacts of the cartridge, and the corresponding electrical contact of the main assembly of an image forming apparatus.

While the invention has been described with reference to the structures disclosed herein, it is not confined to the details set forth, and this application is intended to cover such modifications or changes as may come within the scope of the following claims and their equivalents.

This application claims priority from Japanese Patent Applications Nos. 024968/2008 and 001983/2009 filed Feb. 5, 2008 and Jan. 7, 2009, respectively, which are hereby incorporated by reference.

What is claimed is:

1. An image forming apparatus including a main assembly of the apparatus to which is mountable a cartridge having a storing element for storing information, a cartridge electrical contact electrically connected with the storing element, and a first contact portion, said image forming apparatus comprising:

a movable member including a first shaft, a second shaft, a main assembly electrical contact for electrical connection with the cartridge electrical contact when the cartridge is set to the main assembly of said apparatus, and a second contact portion for being contacted, when the cartridge is mounted to the main assembly of said apparatus, by the first contact portion to receive a force in an inserting direction in which the cartridge is mounted to the main assembly of said apparatus;

a first guide portion, rotatably supporting said first shaft, for guiding said first shaft such that said movable member is rendered movable in the inserting direction by said second contact portion being pushed by the first contact portion when the cartridge is mounted to the main assembly of said apparatus; and a second guide portion for guiding said second shaft by said second contact portion being pushed by the first contact portion when the cartridge is mounted to the main assembly of said apparatus, such that said movable member is rotated about said first shaft in a direction of electrically connecting said main assembly electrical contact to the cartridge electrical contact.

2. An apparatus according to claim 1, wherein said second contact portion functions as a first positioning portion for positioning said movable member in a direction crossing with the inserting direction.

3. An apparatus according to claim 1, wherein said second contact portion is provided on said first shaft.

4. An apparatus according to claim 3, wherein said second contact portion is provided at each of one and the other ends with respect to a direction of an axis of said first shaft.

5. An apparatus according to claim 1, wherein said movable member includes a positioning portion for being contacted, when the cartridge is set to the main assembly of said apparatus, by a third contact portion provided on the cartridge to position said movable member in a rotational direction about said first shaft.

6. An apparatus according to claim 1, further comprising urging means for urging said second shaft in a direction of electrically connecting said main assembly electrical contact with the cartridge electrical contact when the cartridge is mounted to the main assembly of said apparatus.

7. An image forming apparatus including a main assembly of the apparatus to which is mountable a cartridge having a storing element for storing information, a cartridge electrical contact electrically connected with the storing element, and a first contact portion, said image forming apparatus comprising:

a movable member including a shaft, a main assembly electrical contact for electrical connection with the cartridge electrical contact when the cartridge is set to the main assembly of said apparatus, a second contact portion for being contacted, when the cartridge is mounted to the main assembly of the apparatus, by the first contact portion to receive a force in an inserting direction in which the cartridge is mounted to the main assembly of said apparatus;

a guide portion, rotatably supporting said shaft, for guiding said shaft such that said movable member is rendered movable in the inserting direction by said second contact portion being pushed by the first contact portion when the cartridge is mounted to the main assembly of said apparatus; and a link rotatably supporting said movable member to rotate said movable member by said second contact portion being pushed by the first contact portion when the cartridge is mounted to the main assembly of said apparatus, such that said movable member is rotated about said shaft in a direction of electrically connecting said main assembly electrical contact to the cartridge electrical contact.

8. An apparatus according to claim 7, wherein said second contact portion functions as a first positioning portion for positioning said movable member in a direction crossing with the inserting direction.

9. An apparatus according to claim 7, wherein said second contact portion is provided on said shaft.

10. An apparatus according to claim 7, wherein said second contact portion is provided at each of one and the other ends with respect to a direction of an axis of said shaft.

11. An apparatus according to claim 7, wherein said movable member includes a second positioning portion for being contacted, when said cartridge is set to the main assembly of said apparatus, by a third contact portion provided on the cartridge to position said movable member in a rotational direction about said shaft.

12. An apparatus according to claim 7, wherein said link includes an arm member having one end rotatably supported by the main assembly of said apparatus, a slidable member slidable along said arm member and rotatably engaged with said movable member, and an urging member for urging said slidable member toward the other end of said arm member.

13. A cartridge detachably mountable to an image forming apparatus, wherein said image forming apparatus includes a movable member having a shaft, a main assembly electrical contact and an apparatus contact portion, a guide portion, rotatably supporting the shaft, for guiding the shaft such that the movable member is rendered movable, wherein the movable member is supported so as to be rotatable about the shaft by the apparatus contact portion being pushed, said cartridge comprising:

a storing element for storing information;

a cartridge electrical contact electrically connected with said storing element; and a first contact portion contactable to the apparatus contact portion to cause the shaft to be guided by the guide portion so as to move the movable member in a mounting direction of said cartridge and to cause the movable member to rotate about the shaft, thus electrically connecting the main assembly electrical contact to said cartridge electrical contact, when said cartridge is mounted to the main assembly of the apparatus.

14. A cartridge according to claim 13, wherein said first contact portion is disposed upstream of said cartridge electrical contact with respect to an inserting direction in which said cartridge is mounted to the main assembly of the apparatus.

15. A cartridge according to claim 13, wherein said first contact portion positions the movable member with respect to a direction crossing with an inserting direction in which said cartridge is mounted to the main assembly of the apparatus when said cartridge is mounted to the main assembly of the apparatus.

16. A cartridge according to claim 13, further comprising a second contact portion for contacting a second positioning portion provided on the movable member to position the movable member with respect to a rotational direction about the shaft.

17. A cartridge according to claim 13, further comprising an electrophotographic photosensitive member and process means actable on said electrophotographic photosensitive member.

* * * * *